US008827486B2

(12) United States Patent
Lai et al.

(10) Patent No.: US 8,827,486 B2
(45) Date of Patent: Sep. 9, 2014

(54) LAMP TUBE STRUCTURE AND ASSEMBLY THEREOF

(75) Inventors: Chun-Ming Lai, Yuanli Township, Miaoli County (TW); Chih-Yen Lin, Zhubei (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 13/240,763

(22) Filed: Sep. 22, 2011

(65) Prior Publication Data

US 2012/0212951 A1 Aug. 23, 2012

Related U.S. Application Data

(60) Provisional application No. 61/444,848, filed on Feb. 21, 2011.

(51) Int. Cl.
*F21V 29/00* (2006.01)

(52) U.S. Cl.
USPC ..... 362/218; 362/249.02

(58) Field of Classification Search
USPC ..... 362/218, 217.01, 223, 225, 255, 256, 362/260, 294, 649, 652, 217.08, 657–659; 315/51; 439/890
See application file for complete search history.

(56) References Cited

U.S. PATENT DOCUMENTS 1,830,084 A * 11/1931 Magnus Bjorndal ..... 439/741
2,716,226 A * 8/1955 Jonas ..... 439/805

(Continued)

FOREIGN PATENT DOCUMENTS

CN 2101945 U 4/1992
CN 1601830 A 3/2005

(Continued)

OTHER PUBLICATIONS

Varistor Definition from thefreedictionary.com.*

(Continued)

*Primary Examiner* — Diane Lee
*Assistant Examiner* — Naomi M Wolford
(74) *Attorney, Agent, or Firm* — McClure, Qualey & Rodack, LLP

(57) ABSTRACT

A lamp tube structure includes a first end cap, a second end cap, a heat sink holder, a light emitting element array and a lamp cover. The first end cap includes a pair of electrical terminals and a first insulating portion. The electrical terminals are integrated into the first insulating portion by insert molding, and one end of each electrical terminal is protruded from an outside of the first insulating portion. The second end cap includes a grounding terminal and a second insulating portion. The grounding terminal is integrated into the second insulating portion by insert molding, and one end of the grounding terminal is protruded from an outside of the second insulating portion. The light emitting element array is disposed on top surface of the heat sink holder. A bottom surface of the lamp cover is fixed on the heat sink holder for receiving the light emitting element array.

30 Claims, 6 Drawing Sheets

(56) References Cited

U.S. PATENT DOCUMENTS

| | | | | |
|---|---|---|---|---|
| 4,728,835 | A * | 3/1988 | Baines | 310/71 |
| 5,009,614 | A * | 4/1991 | Fogg et al. | 439/497 |
| 6,283,612 | B1 * | 9/2001 | Hunter | 362/240 |
| 6,531,810 | B2 * | 3/2003 | Bult et al. | 313/318.01 |
| 7,354,001 | B2 * | 4/2008 | Wulff et al. | 235/462.45 |
| 7,484,980 | B2 * | 2/2009 | Liao | 439/236 |
| 7,490,957 | B2 * | 2/2009 | Leong et al. | 362/249.05 |
| 8,167,452 | B2 * | 5/2012 | Chou | 362/217.13 |
| 8,220,956 | B2 * | 7/2012 | Lai et al. | 362/218 |
| 8,220,976 | B2 * | 7/2012 | Liu et al. | 362/373 |
| 2005/0070172 | A1 * | 3/2005 | Cheng et al. | 439/736 |
| 2010/0277918 | A1 * | 11/2010 | Chen et al. | 362/249.02 |
| 2011/0194278 | A1 * | 8/2011 | Yang et al. | 362/217.12 |

FOREIGN PATENT DOCUMENTS

| | | | |
|---|---|---|---|
| CN | 201439892 | U | 4/2010 |
| CN | 101737664 | A | 6/2010 |
| CN | 201636803 | U | 11/2010 |
| CN | 201672328 | U | 12/2010 |
| JP | 2006228529 | A | 8/2006 |
| JP | 2006277978 | A | 10/2006 |
| JP | 2009266755 | A | 11/2009 |
| JP | 2010192242 | A | 9/2010 |
| JP | 2010257769 | A | 11/2010 |
| JP | 3164438 | | 12/2010 |
| JP | 2011003213 | A | 6/2011 |
| WO | 2010126083 | A | 11/2010 |

OTHER PUBLICATIONS

JP Office Action dated Mar. 5, 2013.
English Abstract translation of JP2010257769 (Published Nov. 11, 2010).
English Abstract translation of JP2011003213 (Published Jun. 1, 2011).
English Abstract translation of JP2010192242 (Published Sep. 2, 2010).
English Abstract translation of JP2009266755 (Published Nov. 12, 2009).
English Abstract translation of JP2006277978 (Published Oct. 12, 2006).
English Abstract translation of JP2006228529 (Published Aug. 31, 2006).
English Abstract translation of JP3164438 (Published Dec. 2, 2010).
Full English (machine) translation of CN201439892 (Published Apr. 21, 2010).
English Abstract translation of CN201672328 (Published Dec. 15, 2010).
CN Office Action dated May 14, 2014.
Full English (machine) translation of CN101737664 (Published Jun. 16, 2010).
Full English (machine) translation of CN1601830 (Published Mar. 30, 2005).
English Abstract translation of CN201636803 (Published Nov. 17, 2010).
English Abstract translation of CN2101945 (Published Apr. 15, 1992).

* cited by examiner

127

LAMP TUBE STRUCTURE AND ASSEMBLY THEREOF

This application claims the benefit of U.S. provisional application Ser. No. 61/444,848, filed Feb. 21, 2011, the subject matter of which is incorporated herein by reference.

BACKGROUND

1. Technical Field

The disclosure relates in general to a lamp tube structure, and more particularly to a lamp tube structure and assembly thereof.

2. Description of the Related Art

In the modern society, light emitting diodes (LEDs) are so popular and convenient. There are many applications for LEDs such as backlight modules, headlamps, and indicator lamps. Since LEDs have lower driving voltage and long life-span, LEDs consume less power than a traditional fluorescent lamp tube. Thus, conventional fluorescent lamp tubes are gradually replaced by LED tubes.

However, a problem of the LED tube arises when assembling the LED tube. Generally, the LED tube has two end caps, and each of the end caps has two separable individual parts, which makes the assembling process more complicated and increases the cost for assembling. In addition, the end cap with two parts is not strong enough for protecting electrical terminals from impact. Consequently, the reliability of the LED tube is reduced.

SUMMARY

The disclosure is directed to a lamp tube structure and assembly thereof, whose end caps have sufficient strengths to resist impact.

The disclosure is directed to a lamp tube assembly having a surge varistor for absorbing a surge between the electrical terminals.

According to one aspect of the present disclosure, a lamp tube assembly includes a first end cap and a second end cap. The first end cap includes a pair of electrical terminals and a first insulating portion. The electrical terminals are integrated into the first insulating portion by insert molding. One end of each electrical terminal is protruded from an outside of the first insulating portion. The second end cap includes a grounding terminal and a second insulating portion. The grounding terminal is integrated into the second insulating portion by insert molding. One end of the grounding terminal is protruded from an outside of the second insulating portion.

According to another aspect of the present disclosure, a lamp tube assembly includes a first end cap and a second end cap. The first end cap includes a pair of electrical terminals and a first insulating portion. The electrical terminals are integrated into the first insulating portion by insert molding. One end of each electrical terminal is protruded from an outside of the first insulating portion. The second end cap includes a grounding terminal and a second insulating portion. The grounding terminal is integrated into the second insulating portion by insert molding. One end of the grounding terminal is protruded from an outside of the second insulating portion, and another end of the grounding terminal has a cylinder hole structure.

According to yet another aspect of the present disclosure, a lamp tube structure includes a first end cap, a second end cap, a heat sink holder, a light emitting element array and a lamp cover. The first end cap includes a pair of electrical terminals and a first insulating portion. The electrical terminals are integrated into the first insulating portion by insert molding. One end of each electrical terminal is protruded from an outside of the first insulating portion. The second end cap includes a grounding terminal and a second insulating portion. The grounding terminal is integrated into the second insulating portion by insert molding. One end of the grounding terminal is protruded from an outside of the second insulating portion. The light emitting element array is disposed on top surface of the heat sink holder. A bottom portion of the lamp cover is fixed on the heat sink holder.

According to yet another aspect of the present disclosure, a lamp tube structure includes a first end cap, a second end cap, a heat sink holder, a light emitting element array and a lamp cover. The first end cap includes a pair of electrical terminals and a first insulating portion. The electrical terminals are integrated into the first insulating portion by insert molding. One end of each electrical terminal is protruded from an outside of the first insulating portion. The second end cap includes a grounding terminal and a second insulating portion. The grounding terminal is integrated into the second insulating portion by insert molding. One end of the grounding terminal is protruded from an outside of the second insulating portion, and another end of the grounding terminal has a cylinder hole structure. The light emitting element array is disposed on top surface of the heat sink holder. A bottom portion of the lamp cover is fixed on the heat sink holder.

According to a yet another aspect of the present disclosure, a lamp tube assembly for protecting from a surge includes a first end cap and a surge varistor. The first end cap includes a pair of electrical terminals and a first insulating portion. The electrical terminals are integrated into the first insulating portion by insert molding. One end of each electrical terminal is protruded from an outside of the first insulating portion. The surge varistor is disposed within the first end cap. The surge varistor is electrically connected between the pair of electrical terminals.

The above and other aspects of the disclosure will become better understood with regard to the following detailed description of the non-limiting embodiment(s). The following description is made with reference to the accompanying drawings.

DETAILED DESCRIPTION

According to a lamp tube structure and assembly thereof disclosed in an embodiment of the disclosure, a first end cap of the lamp tube is provided with a pair of electrical terminals by insert molding to enhance the joint strength, and a second end cap of the lamp tube is provided with a grounding terminal by insert molding to enhance the joint strength. Consequently, even though impact occurs, the electrical terminals and the grounding terminal are well protected and the probability of being broken is reduced. In the present embodiment of the disclosure, the electrical terminals are supplied with input power, for example, Direct Current (DC) power, for driving the light emitting element array of the lamp tube, and the grounding terminal is installed to eliminate noise via a heat sink holder of the lamp tube to prevent the lamp tube from the interference of noise.

The lamp tube structure of the exemplary embodiment of the disclosure is exemplified by a GX16 lamp tube, but the scope of protection of the invention is not limited thereto.

Figure 1:
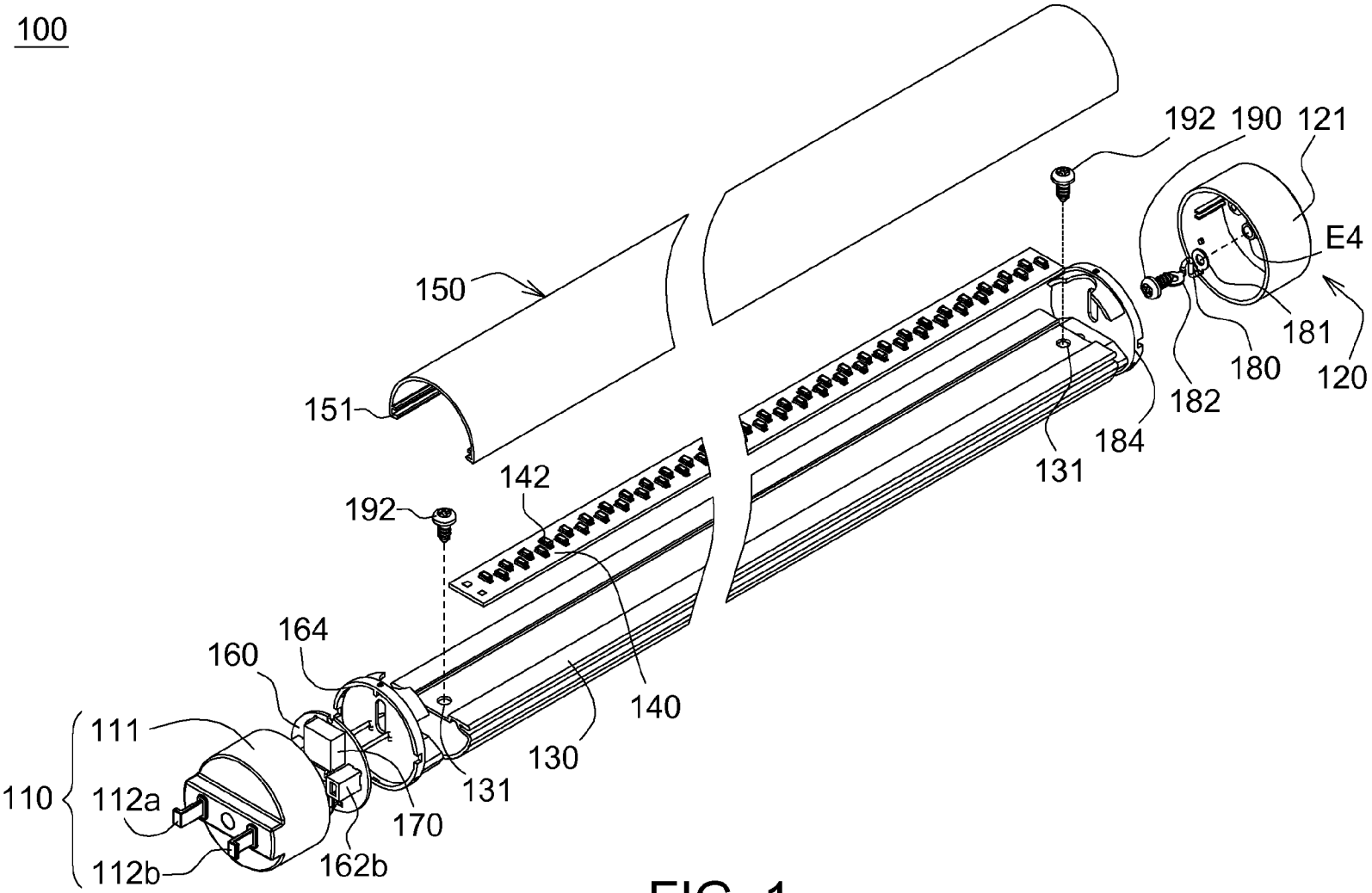
FIG. 1 shows an exploded view of a lamp tube structure and assembly thereof according to an embodiment.
Figure 2A:
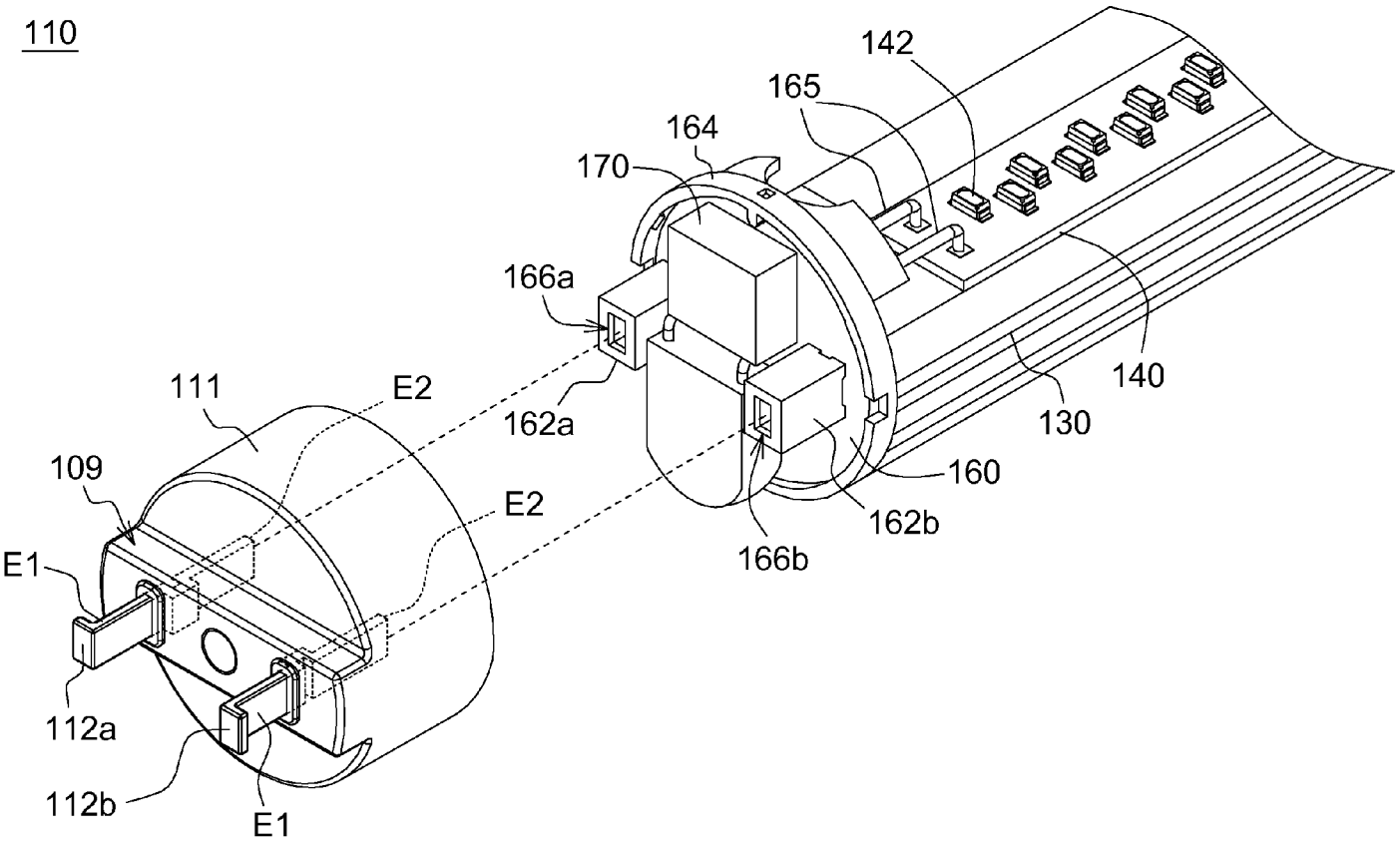
FIGS. 2A and 2B show parts of the lamp tube structure of FIG. 1.
Figure 2B:
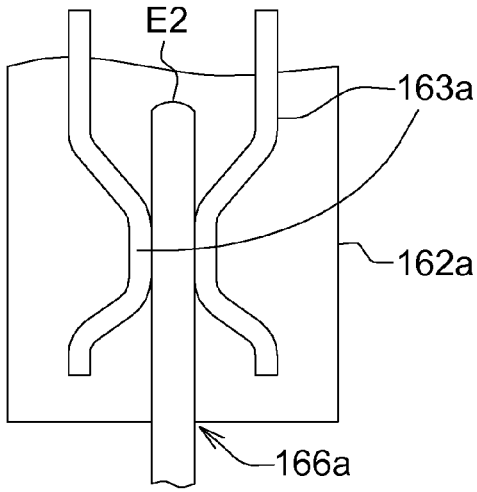

FIG. 1 shows an exploded view of a lamp tube structure and assembly thereof according to an embodiment. FIGS. 2A and 2B show parts of the lamp tube structure of FIG. 1.

Referring to FIG. 1 and FIG. 2A, the lamp tube structure 100 includes a first end cap 110, a second end cap 120, a heat sink holder 130, a light emitting element array 140 and a lamp cover 150. The first end cap 110 includes a pair of electrical terminals (terminals 112*a* and 112*b*) and a first insulating portion 111. The electrical terminals 112*a* and 112*b* are integrated into the first insulating portion 111 by insert molding, and one end (the first end E1) of each electrical terminal is protruded from an outside 109 of the first insulating portion 111. The light emitting element array 140 has a number of light emitting units 142 disposed on top surface of the heat sink holder 130. A lamp cover 150 whose bottom portion 151 fixed on the heat sink holder 130 is provided for receiving the light emitting element array 140.

In addition, referring to FIGS. 1, 2A and 2B, the lamp tube structure 100 further includes a board connector 160 disposed within the first end cap 110. The board connector 160 includes a pair of sockets (sockets 162*a* and 162*b*) and two pairs of metal springs, for example, the pair of metal springs 163*a* within the socket 162*a* (see FIG. 2B). Each pair of metal springs is disposed within a corresponding socket, and another end of each electrical terminal is clipped by the corresponding pair of the metal springs. For example, one pair of the metal springs 163*a* is disposed within the socket 162*a*, and another end of the electrical terminal 112*a* is clipped by the pair of metal springs 163*a*. In an embodiment, the slot 166*a* of the socket 162*a* and the slot 166*b* of the socket 162*b* are separated by a distance (such as 16 mm). The slot 166*a* is corresponding to the second end E2 of the electrical terminal 112*a*, and the slot 166*b* is corresponding to the second end E2 of the electrical terminal 112*b*. The electrical terminal 112*a* and the electrical terminal 112*b* are arranged to extend in parallel inside the first end cap 110, and inserted into the slot 166*a* and the slot 166*b*, respectively. As shown in FIG. 2B, when the second end E2 of the electrical terminal 112*a* laterally contacts with the metal springs 163*a*, the force provided by the metal springs 163*a* fastens the second end E2 of each electrical terminal 112*a* within the socket 162*a*.

Further, referring to FIGS. 1 and 2A, the lamp tube structure 100 further includes a surge varistor 170 disposed on the board connector 160. The surge varistor 170 is electrically connected between the pair of the sockets 162*a* and 162*b* for preventing a surge occurred between the electrical terminals 112*a* and 112*b*. In an embodiment, the board connector 160 is surrounded by a round plate 164. The round plate 164 is mounted between the first end cap 110 and the heat sink holder 130 to fasten the board connector 160 within the first end cap 110. As shown in the FIG. 2A, the board connector 160 is, for example, a printed circuit board having a pair of pins 165. The pins 165 are mounted on the printed circuit board for receiving the power from the electrical terminals 112*a* and 112*b* and electrically connected to the light emitting element array 140. Thus, the light emitting units 142 can be lighted. Exception to an embodiment that the surge varistor 170 is disposed on the board connector 160 in FIG. 2A, the surge varistor 170 can be disposed on the heat sink holder 130 and electrically connected between the sockets 162*a* and 162*b* for preventing a surge occurred between the electrical terminals 112*a* and 112*b*. Since only one surge varistor 170 for the lamp tube structure 100 is needed, the cost and quantity of components is reduced accordingly.

Figure 3A:
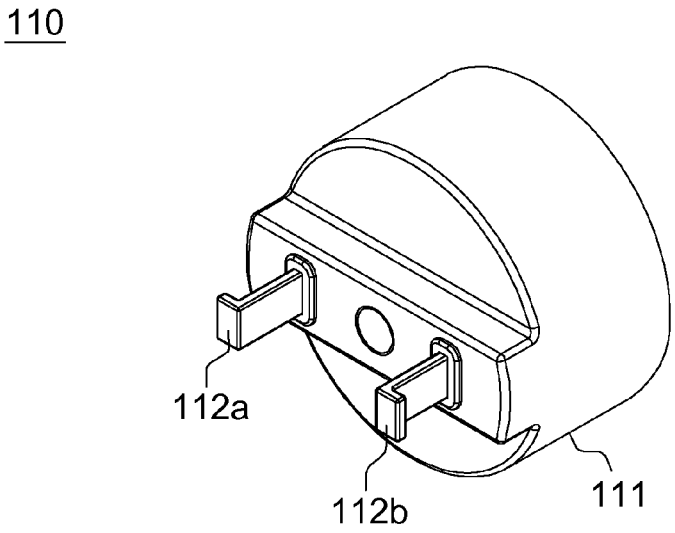
FIGS. 3A and 3B show a profile view and a section view of a first end cap.
Figure 3B:
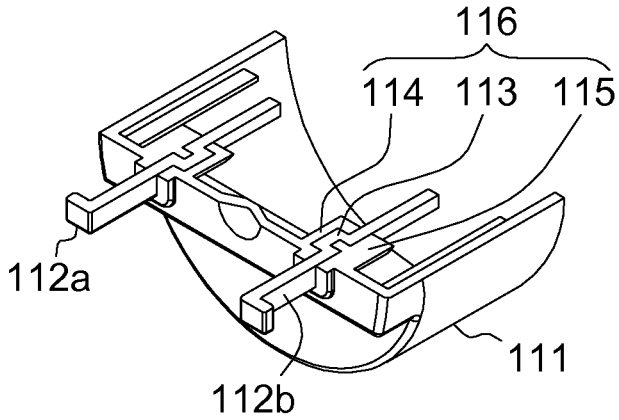

Referring to FIGS. 3A and 3B, FIGS. 3A and 3B show a profile view and a section view of the first end cap 110, respectively. The electrical terminals 112*a* and 112*b* are, for example, implemented by metal pins, which are integrated into the first insulating portion 111 by insert molding. The electrical terminals 112*a* and 112*b* and the first insulating portion 111 are coupled to each other to form a non-linear embedded structure, such as an embedded indentation structure 116 as shown in FIG. 3B. In an embodiment, each of the electrical terminals 112*a*/112*b* has an indentation portion 113, and the first end cap 110 has a fist molding portion 114 and a second molding portion 115. The indentation portion 113 is shaped as being a non-linear portion compared to other linear portion of the electrical terminals 112*a*/112*b* so that the joint strength between the electrical terminals 112*a*/112*b* and the first insulating portion 111 is enhanced.

The embodiment is described in more detail as follows. Before the first molding portion 114 and the second molding portion 115 are molded by a mold (not shown), the indentation portion 113 is firstly placed in a molding cavity (not shown) and then a molding material is inserted into the molding cavity to surround the indentation portion 113. After the molding process is completed, the indentation portion 113 is removed from the molding cavity, and the first molding portion 114 and the second molding portion 115 are coupled with the indentation portion 113 to form a non-linear embedded structure, such as an embedded indentation structure 116 as shown in FIG. 3B. However, the shape of non-linear embedded structure is not limited thereto. In an embodiment, the non-linear embedded structure is implemented to protect electrical terminals 112*a* and 112*b* from being destroyed by an impact when the electrical terminals 112*a* and 112*b* are pulled or pushed by an external force. Thus, the reliability of the electrical terminals 112*a* and 112*b* is increased.

Figure 4A:
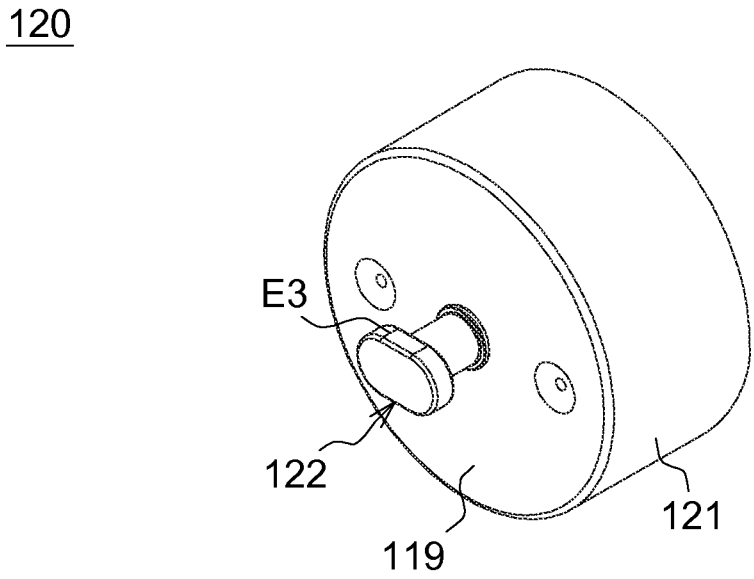
FIGS. 4A and 4B show a profile view and a local section view of a second end cap of a lamp tube respectively according to an embodiment.
Figure 4B:
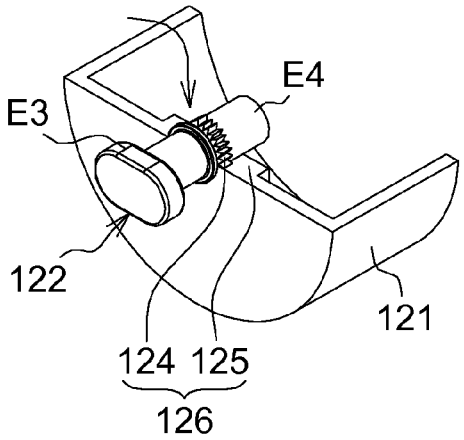

In addition, referring to FIGS. 4A and 4B, FIGS. 4A and 4B show a profile view and a local section view of a second end cap of a lamp tube respectively according to an embodiment, respectively. The second end cap 120 includes a grounding terminal 122 and a second insulating portion 121. The grounding terminal 122 is integrated into the second insulating portion 121 by insert molding, and one end (the third end E3) of the grounding terminal 122 is protruded from an outside 119 of the second insulating portion 121. The grounding terminal 122 is, for example, a T-shaped pillar, which is integrated into the second insulating portion 121 by insert molding. The grounding terminal 122 and the second insulating portion 121 are coupled to each other to form a non-cylinder embedded structure 127, such as an embedded gearwheel structure 126 as shown in FIG. 4B. In an embodiment, the grounding terminal 122 has a gearwheel portion 123, and the second end cap 120 has a molding portion 125. The gearwheel portion 123 is shaped as being a non-cylinder structure compared to other cylinder portion of the grounding terminal 122 so that the joint strength between the grounding terminal 122 and the second insulating portion 121 is enhanced.

Before the molding portion 125 are molded by a mold (not shown), the gearwheel portion 124 is firstly placed in a molding cavity (not shown) and then a molding material is inserted into the molding cavity to surround the gearwheel portion 124. After the molding process is completed, the gearwheel portion 124 is removed from the molding cavity, and the molding portion 125 is coupled with the gearwheel portion 124 to form a non-cylinder embedded structure 127, such as an embedded gearwheel structure 126 as shown in FIG. 4B. However, the shape of non-cylinder embedded structure 127 in this embodiment is not limited thereto. In an embodiment, the non-cylinder embedded structure 127 is applied to protect the grounding terminal 122 from a torque to destroy the grounding terminal 122 when the grounding terminal 122 is rotated by an external force. Thus, the reliability of the grounding terminal 122 is increased.

Figure 5A:
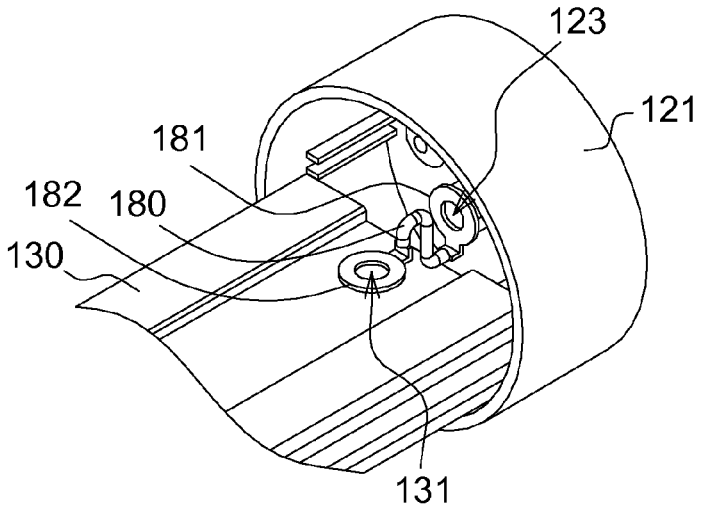
FIG. 5A shows a diagram of a second end cap and a grounding terminal thereof according to an embodiment.

Referring to FIGS. 1 and 5A, FIG. 5A shows a diagram of a second end cap and a grounding terminal thereof according to the embodiment. The lamp tube structure 100 further includes a pair of terminal connectors 181 and 182 and a wire 180. The wire 180 is electrically connected between the terminal connectors 181 and 182. The terminal connector 181 is coupled to one end (the fourth end E4) of the grounding terminal 122, and the terminal connector 182 is coupled to the heat sink holder 130 so that the connection between the grounding terminal 122 and the heat sink holder 130 for ground is completed.

Figure 5B:
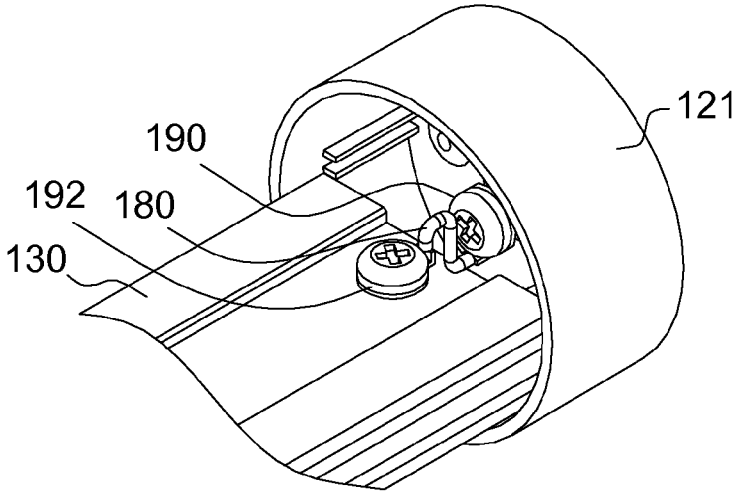
FIGS. 5B and 5C show a diagram and a section view of a second end cap and a grounding terminal thereof after assembled on a heat sink holder according to an embodiment.
Figure 5C:
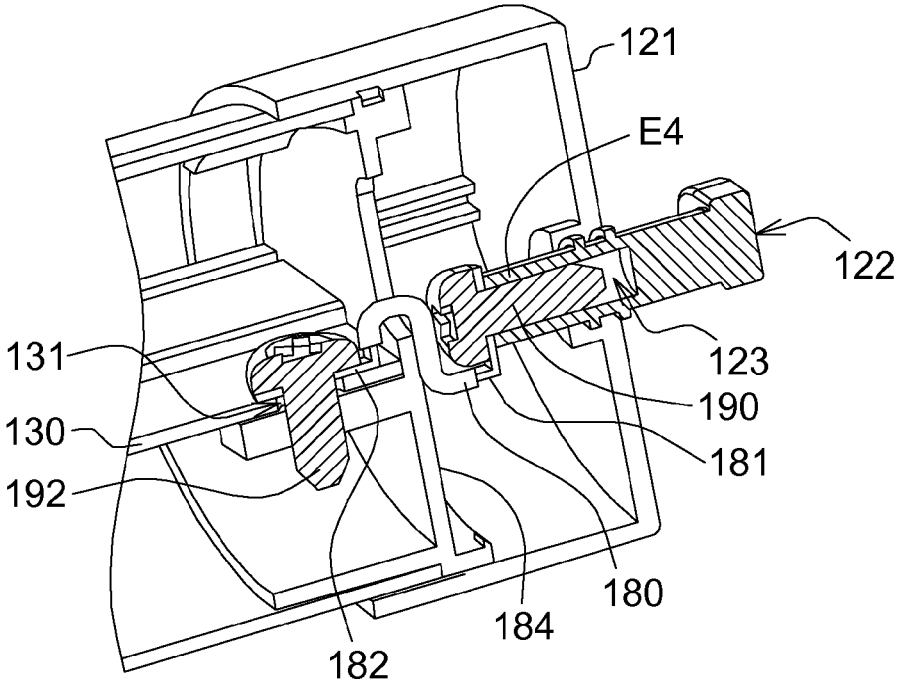

Referring to FIGS. 1, 5B and 5C, FIGS. 5B and 5C show a diagram and a section view of a second end cap and a grounding terminal thereof after assembled on a heat sink holder according to an embodiment, respectively. In an embodiment, the lamp tube structure 100 further includes a first screw 190 and a second screw 192. The first screw 190 passes through the terminal connector 181 and is screwed into a cylinder hole 123 of the grounding terminal 122. The cylinder hole 123 of the grounding terminal 122 is disposed on the fourth end E4 of grounding terminal 122 and aligns to the terminal connector 181. In addition, the second screw 192 passes through the terminal connector 182 and is screwed into a hole 131 of the heat sink holder 130. The hole 131 of the heat sink holder 130 is disposed on top surface and aligns to the terminal connector 182. The first screw 190 and the second screw 192 are applied to fix the terminal connectors 181 and 182 without using a solder, so that the risk due to the false connection of the solder between the heat sink holder 130 and the grounding terminal 122 is avoided.

Referring to FIGS. 1 and 5C, a round plate 184 is mounted between the second end cap 120 and the heat sink holder 130 to fasten the second end cap 120 on the heat sink holder 130. When the second screw 192 is screwed into the heat sink holder 130 along the vertical direction, the round plate 184 is also fixed on the heat sink holder 130 by the second screw 192. After that, the terminal connector 181 on one side of the round plate 184 is placed on the fourth end E4 of the grounding terminal 122, and is screwed on the grounding terminal 122 by the first screw 190 along the horizontal direction. Therefore, it is convenient for operators to mount or dismount the second end cap 120 after the terminal connectors 181 and 182 are assembled on the heat sink holder 130 and the grounding terminal 122, respectively.

According to a lamp tube structure and assembly thereof disclosed in the above embodiment of the disclosure, a first end cap of the lamp tube is provided with a pair of electrical terminals by insert molding to enhance the joint strength, and a second end cap of the lamp tube is provided with a grounding terminal by insert molding to enhance the joint strength. Consequently, the influence of the impact occurred to the electrical terminals and the grounding terminal are reduced to prevent the electrical terminals and the grounding terminal from damage. Thus, the reliability of the electrical terminals and the grounding terminal of the lamp tube structure is increased.

While the disclosure has been described by way of example and in terms of the exemplary embodiment(s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lamp tube assembly, comprising:

a first end cap comprising a pair of electrical terminals and a first insulating portion, the electrical terminals being integrated into the first insulating portion by insert molding, one end of each electrical terminal being protruded from an outside of the first insulating portion for receiving one of DC voltages with different levels; and a second end cap comprising a single grounding terminal and a second insulating portion, the grounding terminal being integrated into the second insulating portion by insert molding, one end of the grounding terminal being protruded from an outside of the second insulating portion for a ground, wherein the grounding terminal has a gearwheel portion, the second insulating portion has a molding portion corresponding to the gearwheel portion, the gearwheel portion and the molding portion are coupled to each other to form an embedded gearwheel structure.

2. The lamp tube assembly according to claim 1, wherein each electrical terminal has an indentation portion, the first insulating portion has a molding portion corresponding to the indentation portion, the indentation portion and the molding portion are coupled to each other to form an U-shaped embedded indentation structure.

3. The lamp tube assembly according to claim 1, further comprising a board connector disposed within the first insulating portion, the board connector comprises a pair of sockets and a pair of metal springs, each metal spring is disposed within a corresponding socket, another end of each electrical terminal is clipped by the corresponding metal spring.

4. The lamp tube assembly according to claim 3, further comprising a surge varistor disposed on the board connector, the surge varistor is electrically connected between the pair of sockets.

5. The lamp tube assembly according to claim 1, further comprising a pair of terminal connectors and a wire, the wire is electrically connected between the terminal connectors, the terminal connectors comprises a first terminal connector, wherein the first terminal connector is coupled to another end of the grounding terminal, and the assembly further comprises a screw passing through the first terminal connector, the grounding terminal further has a cylinder hole, and the screw is screwed in the cylinder hole of the grounding terminal to fix the first terminal connector.

6. A lamp tube assembly, comprising:

a first end cap comprising a pair of electrical terminals and a first insulating portion, the electrical terminals being integrated into the first insulating portion by insert molding, one end of each of the electrical terminals being protruded from an outside of the first insulating portion for receiving one of DC voltages with different levels; and a second end cap comprising a single grounding terminal and a second insulating portion, the grounding terminal being integrated into the second insulating portion by insert molding, one end of the grounding terminal being protruded from an outside of the second insulating portion for a ground, and another end of the grounding terminal has a cylinder hole structure, wherein the grounding terminal has a gearwheel portion, the second insulating portion has a molding portion corresponding to the gearwheel portion, the gearwheel portion and the molding portion are coupled to each other to form an embedded gearwheel structure.

7. The lamp tube assembly according to claim 6, wherein each electrical terminal has a non-linear portion, the first insulating portion has a molding portion corresponding to the non-linear portion, the non-linear portion and the molding portion are coupled to each other to form a non-linear embedded structure.

8. The lamp tube assembly according to claim 7, wherein the non-linear portion is an indentation portion, and the non-linear embedded structure is shaped as an embedded indentation structure.

9. The lamp tube assembly according to claim 6, further comprising a board connector disposed within the first insulating portion, the board connector comprises a pair of sockets and a pair of metal springs, each metal spring is disposed within a corresponding socket, another ends of the electrical terminals are individually clipped by a corresponding metal spring.

10. The lamp tube assembly according to claim 9, further comprising a surge varistor disposed on the board connector, the surge varistor is electrically connected between the sockets.

11. The lamp tube assembly according to claim 6, further comprising a pair of terminal connectors and a wire, the wire is electrically connected between the terminal connectors, the terminal connectors comprises a first terminal connector, wherein the first terminal connector is coupled to another end of the grounding terminal, and the assembly further comprises a screw passing through the first terminal connector and the screw is screwed in the cylinder hole of the grounding terminal.

12. A lamp tube structure, comprising:

a first end cap comprising a pair of electrical terminals and a first insulating portion, the electrical terminals being integrated into the first insulating portion by insert molding, one end of each of the electrical terminals being protruded from an outside of the first insulating portion for receiving one of DC voltages with different levels;

a second end cap comprising a single grounding terminal and a second insulating portion, the grounding terminal being integrated into the second insulating portion by insert molding, one end of the grounding terminal being protruded from an outside of the second insulating portion for a ground, wherein the grounding terminal has a gearwheel portion, the second insulating portion has a molding portion corresponding to the gearwheel portion, the gearwheel portion and the molding portion are coupled to each other to form an embedded gearwheel structure;

a heat sink holder;

a light emitting element array disposed on top surface of the heat sink holder; and a lamp cover whose bottom portion being fixed on the heat sink holder.

13. The lamp tube structure according to claim 12, wherein each electrical terminal has an indentation portion, the first insulating portion has a molding portion corresponding to the indentation portion, the indentation portion and the molding portion are coupled to each other to form an embedded indentation structure.

14. The lamp tube structure according to claim 12, further comprising a board connector disposed within the first insulating portion, the board connector comprises a pair of sockets and a pair of metal springs, each metal spring is disposed within a corresponding socket, another end of each electrical terminal is clipped by the corresponding metal spring.

15. The lamp tube structure according to claim 14, further comprising a surge varistor disposed on the board connector, the surge varistor is electrically connected between the pair of the sockets.

16. The lamp tube structure according to claim 14, further comprising a surge varistor disposed on the heat sink holder, the surge varistor is electrically connected between the heat sink holder and the pair of the sockets.

17. The lamp tube structure according to claim 12, further comprising a pair of terminal connectors and a wire, the wire is electrically connected between the terminal connectors, the terminal connectors comprises a first terminal connector, wherein the first terminal connector is coupled to another end of the grounding terminal, and the lamp tube structure further comprises a screw passing through the first terminal connector, the grounding terminal further has a cylinder hole, and the screw is screwed in the cylinder hole of the grounding terminal.

18. A lamp tube structure, comprising:

a first end cap comprising a pair of electrical terminals and a first insulating portion, the electrical terminals are integrated into the first insulating portion by insert molding, one end of each of the electrical terminals is protruded from an outside of the first insulating portion for receiving one of DC voltages with different levels;

a second end cap comprising a single grounding terminal and a second insulating portion, the grounding terminal is integrated into the second insulating portion by insert molding, one end of the grounding terminal is protruded from an outside of the second insulating portion for a ground, and another end of the grounding terminal has a cylinder hole structure, wherein the grounding terminal has a gearwheel portion, the second insulating portion has a molding portion corresponding to the gearwheel portion, the gearwheel portion and the molding portion are coupled to each other to form an embedded gearwheel structure;

a heat sink holder;

a light emitting element array disposed on top surface of the heat sink holder; and a lamp cover whose bottom portion being fixed on the heat sink holder.

19. The lamp tube structure according to claim 18, wherein each electrical terminal has a non-linear portion, the first insulating portion has a molding portion corresponding to the non-linear portion, the indentation portion and the molding portion are coupled to each other to form a non-linear embedded structure.

20. The lamp tube structure according to claim 19, wherein the non-linear portion is an indentation portion, and the non-linear embedded structure is shaped as an embedded indentation structure.

21. The lamp tube structure according to claim 18, further comprising a board connector disposed within the first insulating portion, the board connector comprises a pair of sockets and a pair of metal springs, each metal spring is disposed within a corresponding socket, another end of each electrical terminal is clipped by the corresponding metal spring.

22. The lamp tube structure according to claim 21, further comprising a surge varistor disposed on the board connector, the surge varistor is electrically connected between the pair of the sockets.

23. The lamp tube structure according to claim 21, further comprising a surge varistor disposed on the heat sink holder, the surge varistor is electrically connected between the lamp holder and the pair of the sockets.

24. The lamp tube structure according to claim 18, further comprising a pair of terminal connectors and a wire, the wire is electrically connected between the terminal connectors, the terminal connectors comprises a first terminal connector, wherein the first terminal connector is coupled to another end of the grounding terminal, and the assembly further comprises a screw passing through the first terminal connector, and the screw is screwed in the cylinder hole of the grounding terminal.

25. A lamp tube assembly for protecting from a surge, comprising:

a first end cap comprising a pair of electrical terminals and a first insulating portion, the electrical terminals being integrated into the first insulating portion by insert molding, one end of each of the electrical terminals being protruded from an outside of the first insulating portion for receiving one of DC voltages with different levels;

a second end cap comprising a single grounding terminal and a second insulating portion, one end of the grounding terminal is protruded from an outside of the second insulating portion for a ground, wherein the grounding terminal has a gearwheel portion, the second insulating portion has a molding portion corresponding to the gearwheel portion, the gearwheel portion and the molding portion are coupled to each other to form an embedded gearwheel structure; and a surge varistor disposed within the first end cap, the surge varistor being electrically connected between the pair of electrical terminals for preventing a surge occurring between the pair of electrical terminals.

26. The lamp tube assembly according to claim 25, wherein each electrical terminal has a non-linear portion, the first insulating portion has a molding portion corresponding to the non-linear portion, the indentation portion and the molding portion are coupled to each other to form a non-linear embedded structure.

27. The lamp tube assembly according to claim 26, wherein the non-linear portion is an indentation portion, and the non-linear embedded structure is shaped as an embedded indentation structure.

28. The lamp tube assembly according to claim 25, further comprising a pair of terminal connectors and a wire, the wire is electrically connected between the terminal connectors, the terminal connectors comprises a first terminal connector, wherein the first terminal connector is coupled to another end of the grounding terminal, and the assembly further comprises a screw passing through the first terminal connector, the grounding terminal further has a cylinder hole, and the screw is screwed in the cylinder hole of the grounding terminal.

29. The lamp tube assembly according to claim 25, further comprising a board connector disposed within the first insulating portion, the board connector comprises a pair of sockets and a pair of metal springs, each metal spring is disposed within a corresponding socket, another end of each electrical terminal is clipped by the corresponding metal spring.

30. The lamp tube assembly according to claim 29, wherein the surge varistor is disposed on the board connector, the surge varistor is electrically connected between the pair of the sockets.

* * * * *